US008859176B2

(12) United States Patent
Kadokura et al.

(10) Patent No.: US 8,859,176 B2
(45) **Date of Patent: *Oct. 14, 2014**

(54) TONER, DEVELOPER, TONER CARTRIDGE, AND IMAGE FORMING APPARATUS

(75) Inventors: Yasuo Kadokura, Kanagawa (JP); Masaru Takahashi, Kanagawa (JP); Shotaro Takahashi, Kanagawa (JP); Shuji Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 188 days.

This patent is subject to a terminal disclaimer.

(21) Appl. No.: 12/943,630

(22) Filed: Nov. 10, 2010

(65) Prior Publication Data

US 2011/0318683 A1 Dec. 29, 2011

(30) Foreign Application Priority Data

Jun. 28, 2010 (JP) ..... 2010-146757

(51) Int. Cl.

| | |
|---|---|
| ***G03G 9/097*** | (2006.01) |
| ***G03G 9/09*** | (2006.01) |
| ***G03G 9/087*** | (2006.01) |
| ***G03G 9/08*** | (2006.01) |

(52) U.S. Cl.

CPC ..... *G03G 9/08704* (2013.01); *G03G 9/08795* (2013.01); *G03G 9/08782* (2013.01); *G03G 9/09* (2013.01); *G03G 2215/0607* (2013.01); *G03G 9/0821* (2013.01); *G03G 9/0819* (2013.01); *G03G 9/08797* (2013.01); *G03G 9/0827* (2013.01)

USPC ..... 430/108.8; 430/110.1; 430/110.3; 430/111.4

(58) Field of Classification Search

USPC ..... 430/110.3, 110.1, 108.8, 105, 111.4; 399/252

See application file for complete search history.

(56) References Cited

U.S. PATENT DOCUMENTS

| | | | |
|---|---|---|---|
| 4,976,777 | A | 12/1990 | Ozawa et al. |
| 5,062,886 | A | 11/1991 | Ozawa et al. |
| 5,198,320 | A | 3/1993 | Vreeland et al. |
| 5,480,481 | A | 1/1996 | Setoguchi et al. |
| 5,482,808 | A | 1/1996 | Kondo et al. |
| 5,753,392 | A | 5/1998 | Ray et al. |
| 5,910,388 | A | 6/1999 | Ray et al. |
| 6,017,670 | A | 1/2000 | Hashizume et al. |

(Continued)

FOREIGN PATENT DOCUMENTS

| | | |
|---|---|---|
| EP | 2 047 335 B1 | 5/2011 |
| JP | A-62-067558 | 3/1987 |

(Continued)

OTHER PUBLICATIONS

Diamond, A.S., et al., ed., Handbook of Imaging Materials, Second Edition, Marcel Dekker, Inc., NY (2002), pp. 146-148.*

(Continued)

*Primary Examiner* — Janis L Dote

(74) *Attorney, Agent, or Firm* — Oliff PLC

(57) ABSTRACT

A toner contains a binder resin and a polyalkylene, wherein the following formula is satisfied:

$$2 \leq A/B \leq 100$$

where A represents a reflectance at a light-receiving angle of +30° and B represents a reflectance at a light-receiving angle of −30°, A and B being measured when a solid fixed image formed by the toner is irradiated with incident light at an incident angle of −45° using a goniophotometer.

9 Claims, 2 Drawing Sheets

(56) References Cited

U.S. PATENT DOCUMENTS

| | | | | |
|---|---|---|---|---|
| 6,245,140 | B1 | 6/2001 | Monden et al. | |
| 6,281,277 | B1 | 8/2001 | Ishii et al. | |
| 7,267,920 | B2 * | 9/2007 | Nakazawa et al. | 430/110.3 |
| 7,413,841 | B2 * | 8/2008 | Yuasa | 430/137.14 |
| 2001/0018157 | A1 | 8/2001 | Aoki et al. | |
| 2002/0192585 | A1 * | 12/2002 | Brenner et al. | 430/108.6 |
| 2005/0214669 | A1 | 9/2005 | Hayashi et al. | |
| 2006/0093937 | A1 | 5/2006 | Grinwald | |
| 2007/0059626 | A1 * | 3/2007 | Inoue et al. | 430/108.8 |
| 2007/0072103 | A1 | 3/2007 | Kawamura et al. | |
| 2007/0141498 | A1 | 6/2007 | Umehara | |
| 2007/0207397 | A1 | 9/2007 | Julien | |
| 2008/0118280 | A1 * | 5/2008 | Han et al. | 399/284 |
| 2008/0131802 | A1 | 6/2008 | Mizutani et al. | |
| 2008/0182198 | A1 | 7/2008 | Kawamura et al. | |
| 2008/0193868 | A1 | 8/2008 | Schuster et al. | |
| 2008/0277490 | A1 | 11/2008 | Kinoshita et al. | |
| 2009/0029278 | A1 * | 1/2009 | Op De Beeck et al. | 430/108.4 |
| 2009/0103950 | A1 | 4/2009 | Nakayama et al. | |
| 2009/0111040 | A1 | 4/2009 | Veregin et al. | |
| 2009/0288580 | A1 | 11/2009 | Cai | |
| 2010/0183964 | A1 | 7/2010 | Yoshida et al. | |
| 2010/0330487 | A1 | 12/2010 | Veregin et al. | |
| 2011/0065034 | A1 | 3/2011 | Arima et al. | |
| 2011/0262654 | A1 | 10/2011 | Yates et al. | |
| 2011/0262858 | A1 | 10/2011 | Nair et al. | |
| 2011/0318682 | A1 * | 12/2011 | Takahashi et al. | 430/105 |
| 2011/0318683 | A1 | 12/2011 | Kadokura et al. | |
| 2013/0078562 | A1 | 3/2013 | Takahashi et al. | |

FOREIGN PATENT DOCUMENTS

| | | |
|---|---|---|
| JP | A-62-100769 | 5/1987 |
| JP | A-02-073872 | 3/1990 |
| JP | A-6-57171 | 3/1994 |
| JP | A-09-106094 | 4/1997 |
| JP | A-9-302257 | 11/1997 |
| JP | A-10-324505 | 12/1998 |
| JP | A-2000-7941 | 1/2000 |
| JP | A-2000-221780 | 8/2000 |
| JP | A-2003-29444 | 1/2003 |
| JP | A-2003-213157 | 7/2003 |
| JP | A-2006-039475 | 2/2006 |
| JP | A-2010-072334 | 4/2010 |
| JP | A-2010-256613 | 11/2010 |
| WO | WO 2006/041658 A1 | 4/2006 |
| WO | WO 2009/026360 A2 | 2/2009 |

OTHER PUBLICATIONS

Whelan, T., ed., Polymer Technology Dictionary, Chapman & Hall, London (1994), p. 256.*

Dec. 17, 2012 Office Action issued in U.S. Appl. No. 12/907,313.

Jan. 23, 2013 Office Action issued in U.S. Appl. No. 12/955,302.

U.S. Appl. No. 12/907,313 to Takahashi et al. filed Oct. 19, 2010.

U.S. Appl. No. 12/955,302 to Takahashi et al. filed Nov. 29, 2010.

May 16, 2013 Office Action issued in U.S. Appl. No. 12/955,302.

Mar. 27, 2014 Office Action issued in U.S. Appl. No. 13/454,597.

Nov. 23, 2012 Office Action issued in Australian Patent Application No. 2012200768, pp. 1-4.

Oct. 11, 2013 Notice of Allowance issued in U.S. Appl. No. 12/955,302.

Jun. 21, 2013 Office Action issued in U.S. Appl. No. 13/364,095.

Oct. 1, 2013 Office Action issued in U.S. Appl. No. 13/564,256.

Jul. 1, 2013 Office Action issued in U.S. Appl. No. 13/532,231.

Aug. 14, 2013 Office Action issued in U.S. Appl. No. 13/454,597.

U.S. Appl. No. 13/454,597 to Nakashima et al. filed Apr. 24, 2012.

U.S. Appl. No. 13/469,642 to Sato et al filed May 11, 2012.

U.S. Appl. No. 13/532,231 Sugitate et al. filed Jun. 25, 2012.

U.S. Appl. No. 13/564,256 Sato et al. filed Aug. 1, 2012.

U.S. Appl. No. 13/364,095 Takahashi et al. filed Feb. 1, 2012.

Nov. 13, 2013 Office Action issued in U.S. Appl. No. 13/469,642.

Diamond et al., "Handbook of Imaging Materials," Second Edition, Marcel Dekker, Inc., (Nov. 2001), pp. 145-164, NY, USA.

Briggs et al., "The Effects of Fusing on Gloss in Electrophotography," IS&T's NIP14 International Conference on Digital Printing Technologies, Oct. 18-23, 1998, Toronto, Ontario, Canada.

Pettersson et al. "Leveling During Toner Fusing: Effects on Surface Roughness and Gloss of Printed Paper," Journal of Imaging Science and Technology 50 (2), pp. 202-215, 2006.

Dec. 4, 2013 Office Action issued in U.S. Appl. No. 13/364,095.

Dec. 19, 2013 Office Action issued in U.S. Appl. No. 13/454,597.

Jun. 26, 2014 Office Action issued in U.S. Appl. No. 13/454,597.

Jun. 26, 2014 Office Action issued in U.S. Appl. No. 13/469,642.

* cited by examiner

TONER, DEVELOPER, TONER CARTRIDGE, AND IMAGE FORMING APPARATUS

CROSS-REFERENCES TO RELATED APPLICATIONS

This application is based on and claims priority under 35 USC 119 from Japanese Patent Application No. 2010-146757 filed Jun. 28, 2010.

BACKGROUND (i) Technical Field

The present invention relates to a toner, a developer, a toner cartridge, and an image forming apparatus.

(ii) Related Art

For the purpose of forming an image having a glossiness similar to metallic luster, glossy toners are used.

SUMMARY

According to an aspect of the invention, there is provided a toner containing a binder resin and a polyalkylene, wherein the following formula is satisfied:

$$2 \leq A/B \leq 100$$

where A represents a reflectance at a light-receiving angle of +30° and B represents a reflectance at a light-receiving angle of −30°, A and B being measured when a solid fixed image formed by the toner is irradiated with incident light at an incident angle of −45° using a goniophotometer.

BRIEF DESCRIPTION OF THE DRAWINGS

Exemplary embodiments of the present invention will be described in detail based on the following figures, wherein.

DETAILED DESCRIPTION

Figure 1:
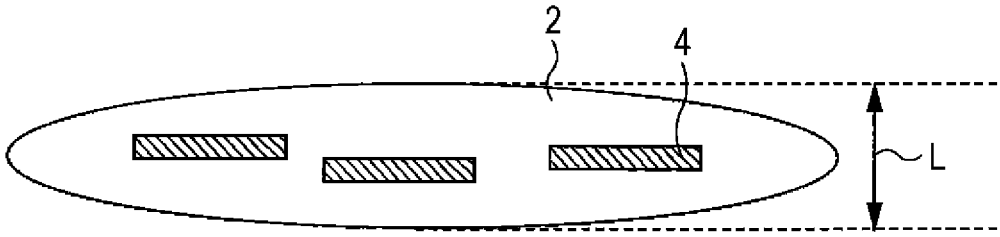
FIG. 1 is a cross-sectional view that schematically shows a toner according to an exemplary embodiment of the present invention.

Exemplary embodiments of the present invention will now be described in detail.

Toner

A toner according to an exemplary embodiment (hereinafter may be simply referred to as "toner") contains a polyalkylene as a release agent, in which when a solid image formed by the toner is irradiated with incident light at an incident angle of −45° and a reflectance A at a light-receiving angle of +30° and a reflectance B at a light-receiving angle of −30° are measured with a goniophotometer, a ratio (A/B) of the reflectance A to the reflectance B is 2 or more and 100 or less, or about 2 or more and about 100 or less.

Herein, the term "glossiness" means that when an image formed by the toner is viewed, the image has a glossiness similar to metallic luster.

The phenomenon that the ratio (A/B) is 2 or more or about 2 or more means that reflection on a side (plus-angle side) opposite to a side (minus-angle side) on which the incident light is irradiated is larger than reflection on the side (minus-angle side) on which the incident light is irradiated, that is, diffuse reflection of the incident light is suppressed. When diffuse reflection, in which incident light is reflected in various directions, occurs and the reflected light thereof is visually observed, colors appear to be dull. Therefore, in the case where the ratio (A/B) is less than 2 or less than about 2, even when the reflected light is viewed, luster cannot be observed and the glossiness is poor.

Thus, by controlling the ratio (A/B) to be 2 or more or about 2 or more, a desired glossiness may be obtained in the formed image.

However, the release agent contained in the toner also affects the glossiness. Specifically, in image formation, when an unfixed toner image formed on a recording medium is fixed by heat fixing, the release agent melted by applying heat exudes on the surface of the image. In this case, since the release agent on the surface of the image is rapidly cooled after the heat fixing, the release agent becomes crystallized on the surface of the image. When large crystals are formed in this manner, a desired glossiness cannot be obtained because the large crystals diffusely reflect light on the surface of the image. This phenomenon is more likely to occur with the increase in the speed of image formation.

In contrast, the toner according to this exemplary embodiment contains a polyalkylene functioning as the release agent. Even when the polyalkylene is melted and then rapidly cooled, the size of crystals thereof does not increase. As a result, diffuse reflection of light caused by the crystals of the release agent on the surface of the image may be suppressed. Thus, a desired glossiness may be obtained in the formed image.

As for the upper limit of the ratio (A/B), when the ratio (A/B) exceeds 100 or about 100, an angle of view at which the reflected light is visible becomes too narrow and a regular-reflection light component increases. As a result, an image is viewed as a dark image at some angles of view. In addition, a toner having a ratio (A/B) of more than 100 or more than about 100 is difficult to produce.

The ratio (A/B) is more preferably 20 or more and 90 or less, or about 20 or more and about 90 or less, and still more preferably 45 or more and 80 or less, or about 45 or more and about 80 or less, and particularly preferably 60 or more and 80 or less, or about 60 or more and about 80 or less.

Measurement of Ratio (A/B) with Goniophotometer

First, the incident angle and the light-receiving angle will be described. In the present exemplary embodiment, when a measurement with a goniophotometer is performed, the incident angle is set to be −45°. This is because a high measurement sensitivity is achieved for images having a wide range of glossiness.

In addition, the reason why the light-receiving angle is set to be −30° and +30° is that the highest measurement sensitivity is achieved in the evaluation of glossy images and non-glossy images.

Next, a method for measuring the ratio (A/B) will be described.

In this exemplary embodiment, in the measurement of the ratio (A/B), first, a "solid image" is formed by the method described below. A developing device of a DocuCentre-III C7600 produced by Fuji Xerox Co., Ltd. is filled with a developer used as a sample, and a solid image with an amount of toner applied of 4.5 g/cm$^2$ is formed on recording paper (OK Top Coat+paper, produced by Oji Paper Co., Ltd.) at a fixing temperature of 190° C. and a fixing pressure of 4.0 kgf/cm$^2$. Note that the "solid image" refers to an image having a coverage rate of 100%.

Incident light at an incident angle of −45° is irradiated on an image portion of the solid image, and a reflectance A at a light-receiving angle of +30° and a reflectance B at a light-receiving angle of −30° are measured with a GC5000L goniophotometer produced by Nippon Denshoku Industries Co., Ltd. Each of the reflectance A and the reflectance B is measured for light having a wavelength in the range of 400 to 700 nm at intervals of 20 nm, and defined as the average of the reflectances at respective wavelengths. The ratio (A/B) is calculated from these measurement results.

Configuration of Toner

From the standpoint of satisfying the ratio (A/B) described above, a toner according to this exemplary embodiment may meet the requirements (1) and (2) below.

(1) The toner has an average equivalent-circle diameter D larger than an average maximum thickness C.

(2) When a cross section of the toner in a thickness direction thereof is observed, the number of pigment particles having long-axis directions that form an angle of −30° to +30° with respect to a long-axis direction of the cross section of the toner is 60% or more or about 60% or more of the total number of pigment particles observed.

FIG. 1 is a cross-sectional view that schematically shows a toner satisfying the requirements (1) and (2) described above. The schematic view shown in FIG. 1 is a cross-sectional view of the toner in the thickness direction thereof.

A toner 2 shown in FIG. 1 is a flat toner having an equivalent-circle diameter larger than a thickness L, and contains pigment particles 4 each having a flaky shape or a substantially flaky shape.

In the case where the toner 2 has a flat shape in which the equivalent-circle diameter is larger than the thickness L as shown in FIG. 1, when the toner moves to an image holding member, an intermediate transfer member, a recording medium, or the like in a step of development or a step of transferring in image formation, the toner tends to move so as to cancel out the charges of the toner to the maximum extent. Therefore, it is believed that the toner is arranged such that the adhering area becomes the maximum. More specifically, it is believed that the flat-shaped toner is arranged such that the flat surface side of the toner faces a surface of a recording medium onto which the toner is finally transferred. Furthermore, in a step of fixing in image formation, it is believed that the flat toner is also arranged by the pressure during fixing such that the flat surface side of the toner faces the surface of the recording medium.

Accordingly, among the pigment particles having a flaky shape or a substantially flaky shape and contained in this toner, pigment particles that satisfy the requirement "having long-axis directions that form an angle of −30° to +30° with respect to a long-axis direction of the cross section of the toner" described in (2) above are believed to be arranged such that the surface side that provides the maximum area faces the surface of the recording medium. It is believed that, when an image formed in this manner is irradiated with light, the proportion of pigment particles that cause diffuse reflection of incident light is reduced and thus the above-described range of the ratio (A/B) may be achieved.

However, in such a toner containing pigment particles having a flaky shape or a substantially flaky shape, when an unfixed toner image formed on a recording medium is fixed by heat fixing in image formation, the pigment particles having the flaky shape or the substantially flaky shape substantially become covers. Thus, the pigment particles inhibit exuding of a release agent melted by heat to the surface of an image, and roughening occurs on the image surface on which the amount of release agent exuded is small. As a result, a desired glossiness cannot be obtained. This phenomenon is more likely to occur with the increase in the speed of image formation.

In contrast, the toner according to this exemplary embodiment contains, as the release agent, a polyalkylene which has a low melt viscosity. Accordingly, even when a toner containing pigment particles having a flaky shape or a substantially flaky shape is used, the release agent satisfactorily exudes to the surface of an image, thus suppressing the roughening of the surface of the image. As a result, a desired glossiness may be obtained in the formed image.

Next, the composition of the toner according to the present exemplary embodiment will be described.

(Release Agent)

The toner according to this exemplary embodiment contains a polyalkylene as a release agent, as described above.

Melt Viscosity

The polyalkylene preferably has a melt viscosity of 1.0 Pa·s or more and 12.0 Pa·s or less or about 1.0 Pa·s or more and about 12.0 Pa·s or less. When the melt viscosity is less than or equal to the upper limit, the polyalkylene may more satisfactorily exude to the surface of an image and the roughening of the surface of the image may be suppressed. As a result, a desired glossiness may be obtained in the formed image. On the other hand, when the melt viscosity is more than or equal to the lower limit, filming may be suppressed. Furthermore, deterioration of a powder fluidity of the toner after drying may be suppressed, and unevenness of a release agent layer formed on the image after fixing may be suppressed. Thus, the occurrence of uneven release may be suppressed, and an uneven glossiness of the image may be visually suppressed.

The melt viscosity of the polyalkylene is more preferably 2.0 Pa·s or more and 10.0 Pa·s or less or about 2.0 Pa·s or more and about 10.0 Pa·s or less, and particularly preferably 3.0 Pa·s or more and 7.0 Pa·s or less or about 3.0 Pa·s or more and about 7.0 Pa·s or less.

Herein, the melt viscosity $\eta 140$ is measured by the method described below.

The melt viscosity $\eta 140$ of the release agent is measured with an E-type viscometer. In the measurement, an E-type viscometer (produced by Tokyo Keiki Inc.) equipped with an oil-circulating constant temperature bath is used. A cone plate having a cone angle of 1.34° is used.

The measurement is specifically conducted as follows. First, the temperature of the circulation device is set to 140° C. An empty sample measuring cup, an empty reference cup, and a cone are set in the measuring device, and a constant temperature is maintained while the oil is circulated. Once the temperature has stabilized, 1 g of a sample is put in the sample measuring cup, and is then allowed to stand for 10 minutes with the cone in a stationary state. After stabilization, the cone is rotated and the measurement is conducted. The rotational speed of the cone is set to 60 rpm. The measurement is conducted three times, and the average of those three values is determined as the viscosity $\eta 140$.

Melting Temperature

The melting temperature of the polyalkylene is preferably 75° C. or higher and 110° C. or lower or about 75° C. or higher and about 110° C. or lower. When the melting temperature of the polyalkylene is lower than or equal to the upper limit, the polyalkylene may be more satisfactorily melted by heat during fixing. Therefore, the polyalkylene may satisfactorily exude to the surface of an image, roughening of the surface of the image may be suppressed, and thus a desired glossiness may be obtained in the formed image. On the other hand, when the melting temperature is higher than or equal to the lower limit, in a drying process, an increase in the amount of release agent that moves to the surface of the wet toner and is isolated may be suppressed, and thus the occurrence of filming may be suppressed. In addition, when the toner is produced by a hetero-aggregation method, a decrease in an encapsulating property during production, the decrease being caused by melting of the release agent, may be suppressed, and good controllability of the particle size may be realized.

The melting temperature of the polyalkylene is more preferably 85° C. or higher and 100° C. or lower or about 85° C. or higher and about 100° C. or lower, and particularly preferably 90° C. or higher and 95° C. or lower or about 90° C. or higher and about 95° C. or lower.

Herein, the melting temperature is measured in accordance with ASTM D 3418-8. Specifically, a differential scanning calorimeter DSC-7 produced by PerkinElmer Inc. is used. Temperature correction at a detection portion of the device is conducted using the melting points of indium and zinc. Correction of the heat quantity is conducted using the heat of melting of indium. A sample is placed in an aluminum pan, and an empty pan is set as a control. The measurement is conducted at a rate of temperature increase of 10° C./minute.

Full Width at Half Maximum of Melting

The full width at half maximum of melting of the polyalkylene is preferably 5° C. or more and 20° C. or less or about 5° C. or more and about 20° C. or less. When the full width at half maximum of melting is less than or equal to the upper limit, fixing defects and an uneven glossiness of an image due to an expansion of the temperature range of crystal melting may be suppressed, and production stability may also be achieved. On the other hand, when the full width at half maximum of melting is higher than or equal to the lower limit, the growth of the crystals of the release agent during fixing may be suppressed, and thus the generation of an uneven glossiness of an image may be suppressed.

The full width at half maximum of melting of the polyalkylene is more preferably 5° C. or more and 18° C. or less or about 5° C. or more and about 18° C. or less, and particularly preferably 7° C. or more and 15° C. or less or about 7° C. or more and about 15° C. or less.

Herein, the full width at half maximum of melting is measured by the method described below.

The full width at half maximum of a main maximum endothermic peak in an exothermic/endothermic curve of differential thermal analysis in accordance with ASTM D 3418-8 is determined. The exothermic/endothermic curve of differential thermal analysis is obtained by the following method.

(1) First, 10 mg of a sample is placed in an aluminum cell, and a cover is placed on the cell (this is referred to as "sample cell"). For comparison, 10 mg of alumina is placed in an aluminum cell, and a cover is placed on the cell (this is referred to as "comparative cell").

(2) The sample cell and the comparative cell are set in a measuring device, and the temperature is increased from 30° C. to 200° C. at a rate of temperature increase of 10° C./minute in a nitrogen atmosphere. The sample cell and the comparative cell are left to stand at 200° C. for 10 minutes.

(3) After the standing, the temperature is decreased to −30° C. at a rate of temperature decrease of −10° C./minute using liquid nitrogen, and the sample cell and the comparative cell are left to stand at −30° C. for 10 minutes.

(4) After the standing, the temperature is increased from −30° C. to 200° C. at a rate of temperature increase of 20° C./minute. The above-mentioned exothermic/endothermic curve is measured in the operation (4) above. A differential scanning calorimeter DSC-7 produced by PerkinElmer Inc. is used as the measuring device.

Specific Examples of Polyalkylene

Examples of the polyalkylene include known release agents such as mineral wax and petroleum wax, e.g., polyethylene wax, paraffin wax, microcrystalline wax, and Fischer-Tropsch wax; and polyalkylenes that are modified products of there types of wax. Among these, polyethylene wax, paraffin wax, and Fischer-Tropsch wax are particularly preferable.

Molecular Weight

The molecular weight of the polyalkylene is preferably 500 or more and 1,000 or less or about 500 or more and about 1,000 or less, more preferably 530 or more and 900 or less or about 530 or more and about 900 or less, and particularly preferably 550 or more and 800 or less or about 550 or more and about 800 or less.

Herein, the molecular weight is measured by the method below.

First, a toner is dissolved in toluene heated at 180° C., and the resulting solution is then cooled to isolate only a crystallized release agent. A tetrahydrofuran (THF)-soluble product of the release agent is measured by gel permeation chromatography (GPC) to calculate the molecular weight thereof. More specifically, the molecular weight of the polyalkylene is measured with a THF solvent using an HLC-8120 GPC system produced by Tosoh Corporation and a TSKgel Super HM-M column (15 cm) produced by Tosoh Corporation. Next, the molecular weight of the polyalkylene is calculated on the basis of a molecular weight calibration curve prepared using monodisperse polystyrene standard samples.

Combination of Two or More Polyalkylenes

The polyalkylenes may be used alone or in combination of two or more polyalkylenes. By using two or more polyalkylenes in combination, when the polyalkylenes are melted during fixing of an image and then rapidly cooled, the size of crystals formed is further reduced. As a result, diffuse reflection of light caused by the crystals of the release agent on the surface of the image may be suppressed, and a desired glossiness may be obtained in the formed image.

As for the polyalkylenes used in combination, among the specific examples listed above, different types of polyalkylenes may be used in combination, or polyalkylenes having different molecular weights may be used in combination.

Examples of the combination of different types of polyalkylenes preferably include the following:

Combination of paraffin wax and paraffin wax

Combination of paraffin wax and Fischer-Tropsch wax

Combination of paraffin wax and polyethylene wax

Combination with Resin

Examples of the combination of a polyalkylene listed above and a resin described below particularly preferably include the following:

Combination of paraffin wax and a polyester resin

Combination of Fischer-Tropsch wax and a polyester resin

Combination of polyethylene wax and a polyester resin

Content

The content of the release agent in the toner is preferably 3 mass percent or more and 20 mass percent or less, and more preferably 5 mass percent or more and 15 mass percent or less.

(Pigment)

The glossy pigment particles used in the toner according to this exemplary embodiment are not particularly limited as long as the pigment particles have a glossiness. Examples thereof include powders of metals such as aluminum, brass, bronze, nickel, stainless steel, and zinc; flaky inorganic crystal substrates coated with a thin layer, such as, mica, barium sulfate, a layer silicate, and a silicate of layer aluminum which are coated with titanium oxide or yellow iron oxide, single-crystal plate-like titanium oxide, basic carbonates; bismuth oxychloride; natural guanine; flaky glass particles; and metal-deposited flaky glass particles.

The content of the pigment in the toner according to this exemplary embodiment is preferably 1 part by mass or more and 70 parts by mass or less, and more preferably 5 parts by mass or more and 50 parts by mass or less relative to 100 parts by mass of the toner described below.

(Binder Resin)

Examples of the binder resin that can be used in this exemplary embodiment include polyester resins; ethylene-based resins such as polyethylene and polypropylene; styrene-based resins such as polystyrene and α-polymethylstyrene; (meth)acrylic resins such as polymethyl methacrylate and polyacrylonitrile; polyamide resin; polycarbonate resins; polyether resins; and copolymer resins thereof. Among these resins, polyester resins are preferably used.

Polyester resins that are particularly preferably used will now be described.

The polyester resins according to this exemplary embodiment may be those obtained by, for example, polycondensation of a polyvalent carboxylic acid and a polyhydric alcohol.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. These polyvalent carboxylic acids are used alone or in combination of two or more.

Among these polyvalent carboxylic acids, the aromatic carboxylic acids are preferably used. Furthermore, in order to form a cross-linked structure or a branched structure and to improve a fixing property, a trivalent or higher carboxylic acid (such as trimellitic acid or an anhydride thereof) is preferably used in combination with a dicarboxylic acid.

Examples of the polyhydric alcohol include aliphatic diols such as ethylene glycol, diethylene glycol, triethylene glycol, propylene glycol, butanediol, hexanediol, neopentyl glycol, and glycerol; alicyclic dials such as cyclohexanediol, cyclohexanedimethanol, and hydrogenated bisphenol A; and aromatic diols such as ethylene oxide adducts of bisphenol A and propylene oxide adducts of bisphenol A. These polyhydric alcohols are used alone or in combination of two or more.

Among these polyhydric alcohols, aromatic diols and alicyclic diols are preferable. Among these, aromatic diols are more preferable. Among these, aromatic diols are more preferable. Furthermore, in order to form a cross-linked structure or a branched structure and to further improve a fixing property, a trivalent or higher polyhydric alcohol (such as glycerol, trimethylolpropane, or pentaerythritol) may also be used in combination with a diol.

The toner according to this exemplary embodiment preferably contains a crystalline polyester resin as a binder resin. Among crystalline polyester resins, crystalline aliphatic polyester resins are preferable because, in general, many of crystalline aromatic polyester resins have a melting temperature higher than a melting temperature range described below.

The content of the crystalline polyester resin in the toner according to this exemplary embodiment is preferably 2 mass percent or more and 30 mass percent or less, and more preferably 4 mass percent or more and 25 mass percent or less.

The melting temperature of the crystalline polyester resin is preferably in the range of 50° C. or higher and 100° C. or lower, more preferably in the range of 55° C. or higher and 95° C. or lower, and particularly preferably in the range of 60° C. or higher and 90° C. or lower.

The term "crystalline polyester resin" according to this exemplary embodiment refers to a polyester resin that does not exhibit a step-like change in the endotherm but has a clear endothermic peak in differential scanning calorimetry (DSC). In the case where the crystalline polyester resin is a polymer prepared by copolymerizing another component with the main chain of the polyester resin, when the content of the other component is 50 mass percent or less, the resulting copolymer is also referred to as a crystalline polyester.

The above crystalline polyester resin is synthesized from an acid (dicarboxylic acid) component and an alcohol (diol) component. In the description below, the term "constituent component derived from an acid" in a polyester resin refers to a moiety that has been the acid component before the synthesis of the polyester resin. The term "constituent component derived from an alcohol" refers to a moiety that has been the alcohol component before the synthesis of the polyester resin.

Constituent Component Derived from Acid

Examples of the acid for forming the constituent component derived from an acid include various dicarboxylic acids. The acid for forming the constituent component derived from an acid in the crystalline polyester resin according to this exemplary embodiment is preferably a straight-chain aliphatic dicarboxylic acid.

Examples thereof include, but are not limited to, oxalic acid, malonic acid, succinic acid, glutaric acid, adipic acid, pimelic acid, suberic acid, azelaic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; and lower alkyl esters and acid anhydrides thereof. Among these aliphatic dicarboxylic acids, adipic acid, sebacic acid, and 1,10-decanedicarboxylic acid are preferable.

The constituent component derived from an acid may contain other constituent components such as a constituent component derived from a dicarboxylic acid having a double bond or a constituent component derived from a dicarboxylic acid having a sulfonic group.

Examples of the dicarboxylic acid having a sulfonic group include, but are not limited to, sodium 2-sulfoterephthalate, sodium 5-sulfoisophthalate, and sodium sulfosuccinate. Examples thereof further include lower alkyl esters and acid anhydrides thereof. Among these, sodium 5-sulfoisophthalate and the like are preferable.

The content of the constituent component derived from an acid (i.e., the content of the constituent component derived from a dicarboxylic acid having a double bond and/or the constituent component derived from a dicarboxylic acid having a sulfonic group) other than the constituent component derived from an aliphatic dicarboxylic acid in the total constituent components derived from acids is preferably 1 constitutional % by mole or more and 20 constitutional % by mole or less, and more preferably 2 constitutional % by mole or more and 10 constitutional % by mole or less.

Herein, the "constitutional % by mole" represents a percentage when the amount of target constituent component derived from an acid in the total amount of constituent components derived from acids or the amount of target constituent component derived from an alcohol in the total amount of constituent components derived from alcohols in the polyester resin is assumed to be 1 unit (mole).

Constituent Component Derived from Alcohol

The alcohol for forming the constitutional component derived from an alcohol is preferably aliphatic diols. Examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, and 1,20-eicosanediol. Among these diols, ethylene glycol, 1,4-butanediol, and 1,6-hexanediol are preferable.

In this exemplary embodiment, the molecular weight of the polyester resin is measured by gel permeation chromatography (GPC) and calculated. Specifically, the molecular weight of the polyester resin is measured with a THF solvent using an HLC-8120 GPC system produced by Tosoh Corporation and a TSKgel Super HM-M column (15 cm) produced by Tosoh Corporation. Next, the molecular weight of the polyester resin is calculated on the basis of a molecular weight calibration curve prepared using monodisperse polystyrene standard samples.

Method for Producing Polyester Resin

A method for producing the polyester resin is not particularly limited, and the polyester resin is produced by a normal polyester polymerization method in which an acid component and an alcohol component are allowed to react with each other. For example, the polyester resin is produced by properly employing a direct polycondensation method, a transesterification method, or the like depending on the types of monomers used. The molar ratio (acid component/alcohol component) in the reaction between the acid component and the alcohol component is different depending on the reaction conditions and the like. However, the molar ratio is preferably about 1/1 from the standpoint of achieving a high molecular weight.

Examples of a catalyst that can be used in the production of the polyester resin include compounds of an alkali metal such as sodium or lithium; compounds of an alkaline earth metal such as magnesium or calcium; compounds of a metal such as zinc, manganese, antimony, titanium, tin, zirconium, or germanium; phosphorous acid compounds; phosphoric acid compounds; and amine compounds.

(Other Additives)

Besides the components described above, other components such as an internal additive, a charge control agent, an inorganic powder (inorganic particles), organic particles, and the like may also be optionally incorporated in the toner according to this exemplary embodiment.

Examples of the charge control agent include quaternary ammonium salt compounds, nigrosine compounds, dyes composed of a complex of aluminum, iron, chromium, or the like, and triphenylmethane-based pigments.

Examples of the inorganic particles include known inorganic particles such as silica particle, titanium oxide particles, alumina particles, cerium oxide particles, and particles obtained by hydrophobizing the surfaces of these particles. These inorganic particles may be used alone or in combinations of two or more. Among these inorganic particles, silica particles, which have a refractive index lower than that of the above-mentioned binder resin, are preferably used. The silica particles may be subjected to a surface treatment. For example, silica particles surface-treated with a silane coupling agent, a titanium coupling agent, silicone oil, or the like are preferably used.

Characteristics of Toner

Average Maximum Thickness C and Average Equivalent-Circle Diameter D

As described in (1) above, the toner according to this exemplary embodiment preferably has the average equivalent-circle diameter D larger than the average maximum thickness C thereof. The ratio (C/D) of the average maximum thickness C to the average equivalent-circle diameter D is more preferably in the range of 0.001 or more and 0.500 or less, or about 0.001 or more and about 0.500 or less, further preferably in the range of 0.010 or more and 0.200 or less, or about 0.010 or more and about 0.200 or less, and particularly preferably in the range of 0.050 or more and 0.100 or less or about 0.050 or more and about 0.100 or less.

When the ratio (C/D) is 0.001 or more or about 0.001 or more, the strength of the toner may be improved, and breakage of the toner due to a stress during image formation may be suppressed. Thus, a decrease in charges, the decrease being caused by exposure of the pigment, and fogging caused as a result thereof may be suppressed. On the other hand, when the ratio (C/D) is 0.500 or less or about 0.500 or less, a good glossiness may be obtained.

The average maximum thickness C and the average equivalent-circle diameter D are measured by the methods below.

Toner particles are placed on a smooth surface and uniformly dispersed by applying vibrations. One thousand toner particles are observed with a color laser microscope VK-9700 produced by Keyence Corporation at a magnification of 1,000 times to measure the maximum thickness C and the equivalent-circle diameter D of a surface viewed from the top, and the arithmetic averages thereof are calculated to determine the average maximum thickness C and the average equivalent-circle diameter D.

Angle Formed by Long-Axis Direction of Pigment Particle and Long-Axis Direction of Cross Section of Toner As described in (2) above, when a cross section of a toner in the thickness direction thereof is observed, the number of pigment particles having long-axis directions that form an angle of −30° to +30° with respect to a long-axis direction of the cross section of the toner is preferably 60% or more or about 60% or more of the total number of pigment particles observed. Accordingly, in some embodiments, "E" is a ratio (%) of the number of pigment particles having long-axis directions that form an angle of −30° to +30° with respect to a long-axis direction of a cross section of the toner in a thickness direction thereof to the total number of pigment particles observed in the cross section that is preferably 60% or more and, thus, the following equation $$E \geq 60$$

is satisfied. Furthermore, the number of pigment particles is more preferably 70% or more and 95% or less or about 70% or more and about 95% or less, and particularly preferably 80% or more and 90% or less or about 80% or more and about 90% or less.

When the above number is 60% or more or about 60% or more, a good glossiness may be obtained.

A method for observing a cross section of a toner will be described.

Toner particles are embedded in a mixture of a bisphenol A-type liquid epoxy resin and a curing agent, and a sample for cutting is then prepared. Next, the sample for cutting is cut at −100° C. using a cutting machine with a diamond knife (a LEICA ultramicrotome (produced by Hitachi High-Technologies Corporation) is used in this exemplary embodiment) to prepare a sample for observation. The resulting sample is observed with a transmission electron microscope (TEM) at a magnification of about 5,000 times to observe cross sections of the toner particles. For observed 1,000 toner particles, the number of pigment particles having long-axis directions that form an angle of −30° to +30° with respect to the long-axis direction of the cross section of the toner is counted using image analysis software, and the proportion thereof is calculated.

The term "long-axis direction of the cross section of the toner" refers to a direction orthogonal to a thickness direction of the toner having an average equivalent-circle diameter D larger than the average maximum thickness C, and the term "long-axis directions" of pigment particles" refers to length directions of the pigment particles.

The toner according to this exemplary embodiment preferably has a volume average particle diameter $D_{50}$ of 1 μm or more and 30 μm or less, more preferably 3 μm or more and 20 μm or less, and further preferably 5 μm or more and 10 μm or less.

The volume average particle diameter $D_{50}$ is determined as follows. A cumulative volume distribution curve and a cumulative number distribution curve are drawn from the smaller particle diameter side, respectively, for each particle size range (channel) divided on the basis of a particle size distribution measured with a measuring instrument such as a COULTER COUNTER TA-II or MULTISIZER II (produced by Beckman Coulter Inc.). The particle diameter providing 16% accumulation is defined as that corresponding to volume $D_{16v}$ and number $D_{16p}$, the particle diameter providing 50% accumulation is defined as that corresponding to volume $D_{50v}$ and number $D_{50p}$, and the particle diameter providing 84% accumulation is defined as that corresponding to volume $D_{84v}$ and number $D_{84p}$. The volume-average particle size distribution index (GSDv) is calculated as $(D_{84v}/D_{16v})^{1/2}$ using these values.

Method for Producing Toner

The toner according to this exemplary embodiment is produced by a known method such as a wet method or a dry method. In particular, the toner according to this exemplary embodiment is preferably produced by a wet method. Examples of the wet method include a melt suspension method, an emulsion aggregation method, and a dissolution suspension method. Among these methods, the emulsion aggregation method is particularly preferably employed.

The emulsion aggregation method is a method including preparing dispersion liquids (such as an emulsion and a pigment dispersion liquid) each containing a component (such as a binder resin or a coloring agent) contained in a toner, mixing the dispersion liquids to prepare a mixed liquid, and then heating the resulting aggregated particles to the melting temperature or the glass transition temperature of the binder resin or higher (in producing a toner containing both a crystalline resin and an amorphous resin, to a temperature higher than or equal to the melting temperature of the crystalline resin and higher than or equal to the glass transition temperature of the amorphous resin) to aggregate the toner components and cause the toner components to coalesce.

As described above, the toner according to this exemplary embodiment may meet the requirements of (1) and (2) above. When the toner is produced by the emulsion aggregation method, the toner may be prepared by, for example, the method described below.

First, pigment particles are prepared, and the pigment particles are mixed with a binder resin by dispersing and dissolving in a solvent. The resulting mixture is dispersed in water by phase-inversion emulsification or shear emulsification to form glossy pigment particles coated with the resin. Other components (e.g., a release agent and a resin for a shell) are added, and a flocculant is further added thereto. The temperature of the resulting mixture is increased to near the glass transition temperature (Tg) of the resin under stirring to form aggregated particles. In this step, by stirring at a high stirring speed (for example, 500 rpm or more and 1,500 rpm or less) using, for example, a blade for forming a laminar flow, the blade including two paddles, the glossy pigment particles are aligned within the aggregated particles in the long-axis direction thereof, and the aggregated particles are also aggregated in the long-axis direction. Thus, the thickness of the toner is decreased (that is, the requirement (1) above is satisfied). Finally, the pH of the mixture is adjusted to be alkaline in order to stabilize the particles, and the temperature is then increased to the glass transition temperature (Tg) or higher but not higher than the melting temperature (Tm) of the toner to cause the aggregated particles to coalesce. In this coalescing step, by causing aggregated particles to coalesce at a lower temperature (for example, 60° C. or higher and 80° C. or lower), the movement of the components caused by the rearrangement thereof is suppressed, and the orientation of the pigment particles is maintained. Thus, a toner that satisfies the requirement (2) above is obtained.

The stirring speed is more preferably 650 rpm or more and 1,130 rpm or less, and particularly preferably 760 rpm or more and 870 rpm or less. The temperature in the coalescing step is more preferably 63° C. or higher and 75° C. or lower, and particularly preferably 65° C. or higher and 70° C. or lower.

(External Additives)

In this exemplary embodiment, external additives such as a fluidizer and an aid may be added to treat the surfaces of the toner particles. Examples of the external additives include known particles such as inorganic particles, e.g., silica particles, titanium oxide particles, alumina particles, cerium oxide particles, and carbon black; and polymer particles, e.g., polycarbonate particles, polymethyl methacrylate particles, and silicone resin particles, the surfaces of these particles being subjected to a hydrophobizing treatment.

Developer

The toner according to this exemplary embodiment may be used as a one-component developer as it is or a two-component developer in combination with a carrier.

The carrier that can be used in the two-component developer is not particularly limited and known carriers may be used. Examples thereof include magnetic metals such as iron, nickel and cobalt; magnetic oxides such as ferrite and magnetite; resin-coated carriers including a resin coating layer provided on the surface of any of these core materials; and magnetic powder-dispersed carriers. Alternatively, the carrier may be a resin-coated carrier in which an electrically conductive material or the like is dispersed in a matrix resin.

Examples of the coating resin and the matrix resin used in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins having organosiloxane bonds and modified resins thereof, fluorocarbon resins, polyesters, polycarbonates, phenolic resins, and epoxy resins.

Examples of the electrically conductive material include, but are not limited to, metals such as gold, silver, and copper, carbon black, titanium oxide, zinc oxide, barium sulfate, aluminum borate, potassium titanate, and tin oxide.

Examples of the core material of the carrier include magnetic metals such as iron, nickel, and cobalt; magnetic oxides such as ferrite and magnetite; and glass beads. In order to use the carrier in a magnetic brush method, the carrier is preferably composed of a magnetic material. The core material of the carrier generally has a volume average particle diameter in the range of 10 μm or more and 500 μm or less, and preferably in the range of 30 μm or more and 100 μm or less.

To coat the surface of the core material of the carrier with a resin, for example, the coating is performed using a solution for forming a coating layer, the solution being prepared by dissolving the coating resin and optional various additives in a solvent. The solvent is not particularly limited, and may be selected in view of the coating resin used, application suitability, and the like.

Specific examples of the resin coating method include a dipping method in which a core material of the carrier is dipped in a solution for forming a coating layer, a spray method in which a solution for forming a coating layer is sprayed onto the surface of a core material of the carrier, a fluidized bed method in which a solution for forming a coating layer is sprayed while floating a core material of the carrier with flowing air, and a kneader coater method in which a core material of the carrier and a solution for forming a coating layer are mixed in a kneader coater, and a solvent is then removed.

The mixing ratio (mass ratio) of the toner to the carrier in the two-component developer according to this exemplary embodiment is preferably toner:carrier=1:100 or more and 30:100 or less, and more preferably, 3:100 or more and 20:100 or less.

Image Forming Apparatus

Figure 2:
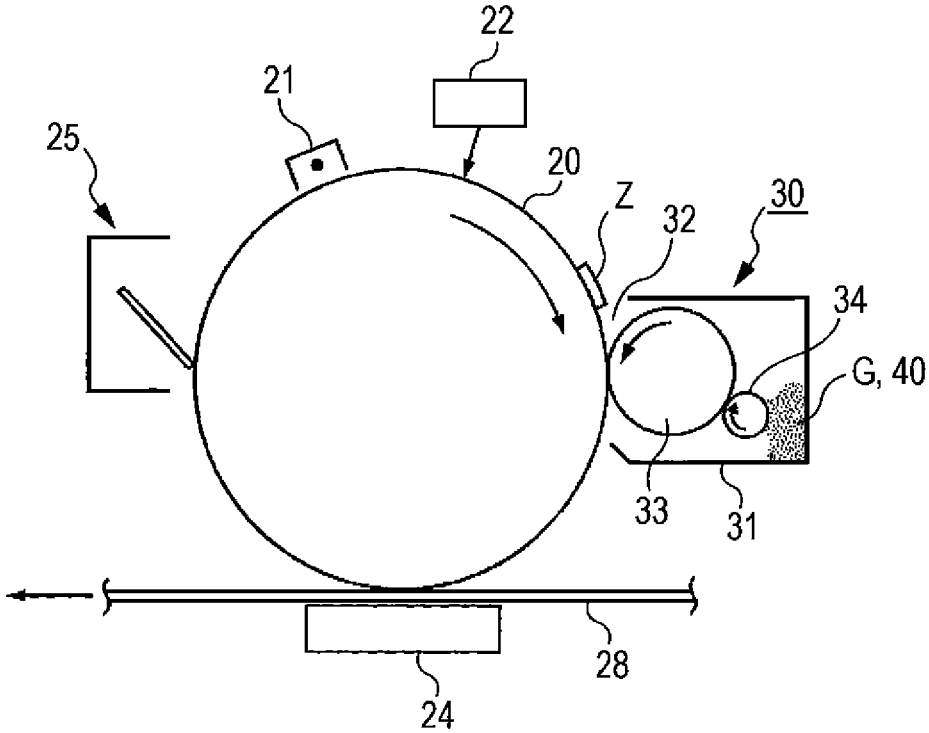
FIG. 2 is a schematic structural view showing an image forming apparatus to which an exemplary embodiment of the present invention is applied.

FIG. 2 is a schematic structural view showing an exemplary embodiment of an image forming apparatus including a developing device to which the toner according to the above exemplary embodiment is applied.

Referring to the figure, the image forming apparatus according to this exemplary embodiment includes a photoconductor drum 20 behaving as an image holding member that rotates in a certain direction. A charging device 21 configured to charge the photoconductor drum 20, an exposure device 22 behaving as a latent image forming device configured to form an electrostatic latent image Z on the photoconductor drum 20, a developing device 30 configured to visualize the electrostatic latent image Z formed on the photoconductor drum 20, a transfer device 24 configured to transfer a toner image that has been visualized on the photoconductor drum 20 to recording paper 28, and a cleaning device 25 configured to clean the residual toner on the photoconductor drum 20 are sequentially arranged around the photoconductor drum 20.

In this exemplary embodiment, as shown in FIG. 2, the developing device 30 includes a developing housing 31 that accommodates a developer G containing a toner 40. In this developing housing 31, an opening 32 for development is opened so as to face the photoconductor drum 20, a development roller (development electrode) 33 behaving as a toner holding member is provided so as to face the opening 32 for development. By applying a certain development bias to the development roller 33, a development electric field is formed in a development region disposed between the photoconductor drum 20 and the development roller 33. Furthermore, a charge injection roller (injection electrode) 34 behaving as a charge injection member is provided in the developing housing 31 so as to face the development roller 33. In particular, in this exemplary embodiment, the charge injection roller 34 also functions as a toner supply roller for supplying the toner 40 to the development roller 33.

Here, the rotation direction of the charge injection roller 34 may be appropriately selected. Considering a toner supply property and a charge injection property, the charge injection roller 34 may rotate in the same direction as the development roller 33 at a position at which the charge injection roller 34 faces the development roller 33 with a difference in the peripheral speed (for example, 1.5 times or more), the toner 40 may be sandwiched in an area between the charge injection roller 34 and the development roller 33, and charges may be injected into the toner 40 through friction.

Next, the operation of the image forming apparatus according to the exemplary embodiment will be described.

When an image forming process is started, first, the surface of the photoconductor drum 20 is charged by the charging device 21, the exposure device 22 writes an electrostatic latent image Z on the charged photoconductor drum 20, and the developing device 30 visualizes the electrostatic latent image Z as a toner image. Subsequently, the toner image on the photoconductor drum 20 is transported to a transfer region, and the transfer device 24 electrostatically transfers the toner image formed on the photoconductor drum 20 to the recording paper 28. The residual toner on the photoconductor drum 20 is cleaned with the cleaning device 25. The toner image on the recording paper 28 is fixed by a fixing device (not shown) to obtain an image.

Process Cartridge and Toner Cartridge

Figure 3:
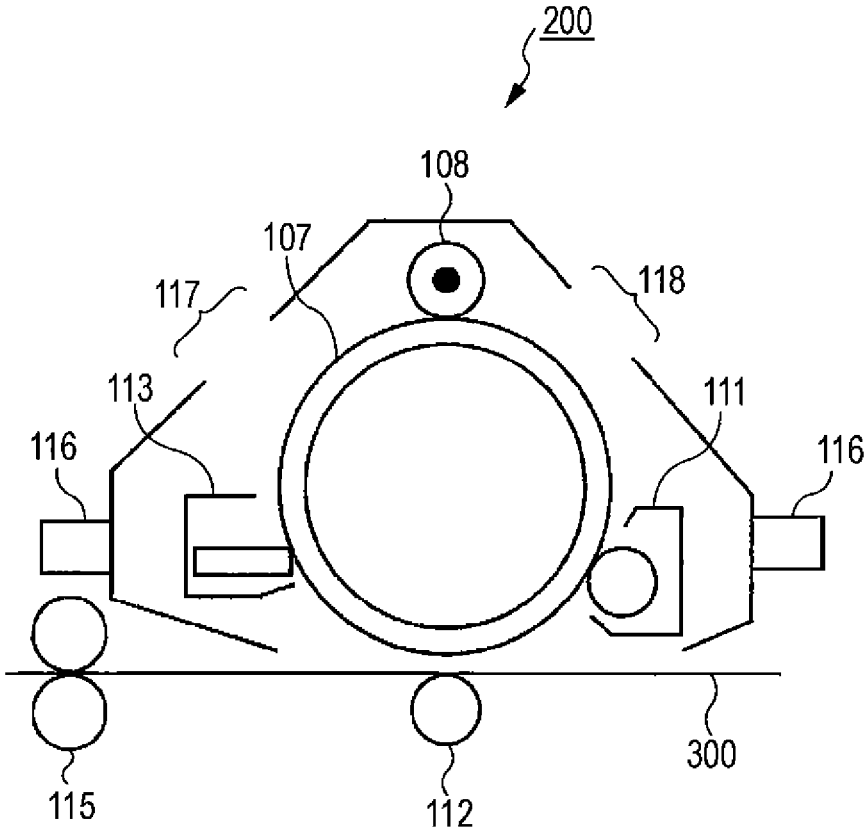
FIG. 3 is a schematic structural view showing an example of a process cartridge according to an exemplary embodiment of the present invention.

FIG. 3 is a schematic structural view showing an example of a process cartridge according to an exemplary embodiment of the present invention. The process cartridge according to this exemplary embodiment accommodates the toner according to the above exemplary embodiment and includes a toner holding member that holds and transports the toner.

A process cartridge 200 shown in FIG. 3 is assembled by integrally combining a charging roller (charging device) 108, a developing device 111 that accommodates the toner of the exemplary embodiment described above, a photoconductor cleaning device 113, an opening 118 for exposure, and an opening 117 for erasing exposure by using a mounting rail 116, together with a photoconductor 107 behaving as an image holding member. This process cartridge 200 is detachable with respect to a body of an image forming apparatus including a transfer device 112 configured to electrostatically transfer a toner image formed on the photoconductor 107 to recording paper 300, a fixing device 115 configured to fix the toner image on the recording paper 300, and other components (not shown). The process cartridge 200 constitutes the image forming apparatus together with the body of the image forming apparatus.

The process cartridge 200 shown in FIG. 3 includes the charging roller 108, the developing device 111, the cleaning device 113, the opening 118 for exposure, and the opening 117 for erasing exposure. However, these devices may be selectively combined. The process cartridge according to this exemplary embodiment includes the developing device 111 and at least one of the photoconductor 107, the charging roller 108, the cleaning device (cleaning unit) 113, the opening 118 for exposure, and the opening 117 for erasing exposure.

Next, a toner cartridge according to an exemplary embodiment of the present invention will be described. The toner cartridge of the this exemplary embodiment is detachably mounted on an image forming apparatus and accommodates at least a toner to be supplied to a developing unit provided in the image forming apparatus, in which the toner is the toner according to the exemplary embodiment described above. It is sufficient that the toner cartridge of this exemplary embodiment accommodates at least a toner. The toner cartridge may accommodate a developer depending on the structure of the image forming apparatus.

The image forming apparatus shown in FIG. 2 has a configuration in which a toner cartridge (not shown) is detachably mounted, and the developing device 30 is connected to the toner cartridge through a toner supply tube (not shown).

When the toner accommodated in the toner cartridges is used up, the toner cartridges may be replaced with a new one.

EXAMPLES

The exemplary embodiment will now be more specifically described by way of Examples and Comparative Examples, but the present invention is not limited to the Examples below. In the following description, "part" and "%" are based on mass unless otherwise specified.

Example 1

Method for Producing Glossy Toner

Synthesis of Binder Resin (1)

Bisphenol A-ethylene oxide 2-mole adduct: 216 parts
Ethylene glycol: 38 parts
Terephthalic acid: 183 parts
Dodecenyl succinic acid: 46 parts
Tetrabutoxy titanate (catalyst): 0.037 parts The above components are put in a two-necked flask dried by heating. Nitrogen gas is introduced into the flask so as to maintain an inert atmosphere, and the temperature is increased while stirring. Subsequently, a polycondensation reaction is conducted at 160° C. for seven hours. The temperature is then increased to 220° C. while the pressure is slowly reduced to 10 Torr, and the atmosphere is maintained for four hours. The pressure is temporarily returned to the normal pressure, and 9 parts of trimellitic anhydride is added to the reaction mixture. The pressure is again slowly reduced to 10 Torr, and the atmosphere is maintained at 220° C. for one hour, thus synthesizing a binder resin (1).

Preparation of Resin Particle Dispersion Liquid (1)

Binder resin (1): 160 parts
Ethyl acetate: 233 parts
Aqueous sodium hydroxide solution (0.3 N): 0.1 parts The above components are put in a 1,000-mL separable flask and heated at 70° C. and stirred with a Three-One motor (produced by Shinto Scientific Co., Ltd.) to prepare a resin mixed liquid. Next, 373 parts of ion-exchange water is slowly added thereto while further stirring the resin mixed liquid to perform phase-inversion emulsification, and the solvent is removed. Thus, a resin particle dispersion liquid (1) (solid content concentration: 30%) is obtained.

Preparation of Resin Particle Dispersion Liquid (2)

Styrene (produced by Wako Pure Chemical Industries, Ltd.): 325 parts
n-Butyl acrylate (produced by Wako Pure Chemical Industries, Ltd.): 75 parts
β-Carboxyethyl acrylate (produced by Rhodia Nicca, Ltd.): 9 parts
1,10-Decanediol diacrylate (produced by Shin-Nakamura Chemical Co., Ltd.): 1.5 parts
Dodecanethiol (produced by Wako Pure Chemical Industries, Ltd.): 2.7 parts The above components are mixed in advance and dissolved to prepare a solution. A surfactant solution prepared by dissolving 4 parts of anionic surfactant (produced by The Dow Chemical Company, DOWFAX A211) in 960 parts of ion-exchange water is put in a flask. Subsequently, 413.2 parts of the above-prepared solution is put in the flask to conduct dispersion and emulsification, and 50 parts of ion-exchange water in which 6 parts of ammonium persulfate is dissolved is added thereto while the resulting mixture is slowly stirred and mixed for 10 minutes.

Subsequently, the atmosphere in the flask is sufficiently replaced with nitrogen, and the flask is then heated in an oil bath until the temperature in the flask is increased to 70° C. while stirring the flask. Emulsion polymerization is continued for five hours in this state to obtain a resin particle dispersion liquid (2) (solid content concentration: 30%).

Preparation of Release Agent Dispersion Liquid (1)

Polyethylene wax (produced by Toyo-Petrolite Co., Ltd., Polywax 600 (PW 600)): 50 parts
Anionic surfactant (produced by Dai-Ichi Kogyo Seiyaku Co., Ltd., NEOGEN RK): 1.0 part
Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.22 μm are dispersed.

Preparation of Release Agent Dispersion Liquid (2)

Paraffin wax (produced by Nippon Seiro Co., Ltd., FNP0090): 50 parts
Anionic surfactant (produced by Dai-Ichi Kogyo Seiyaku Co., Ltd., NEOGEN RK): 1.0 part
Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.23 μm are dispersed.

Preparation of Release Agent Dispersion Liquid (3)

Fischer-Tropsch wax (produced by Nippon Seiro Co., Ltd., HNP0190): 50 parts
Anionic surfactant (produced by Dai-Ichi Kogyo Seiyaku Co., Ltd., NEOGEN RK): 1.0 part
Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (4)

Fischer-Tropsch wax (produced by Nippon Seiro Co., Ltd., HNP-12): 50 parts
Anionic surfactant (produced by Dai-Ichi Kogyo Seiyaku Co., Ltd., NEOGEN RK): 1.0 part
Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (5)

Fischer-Tropsch wax (produced by Nippon Seiro Co., Ltd., HNP-11): 50 parts
Anionic surfactant (produced by Dai-Ichi Kogyo Seiyaku Co., Ltd., NEOGEN RK): 1.0 part
Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.20 μm are dispersed.

Preparation of Release Agent Dispersion Liquid (6)

Fischer-Tropsch wax (produced by Nippon Seiro Co., Ltd., HNP-10): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.20 μm are dispersed.

Preparation of Release Agent Dispersion Liquid (7)

Fischer-Tropsch wax (produced by Nippon Seiro Co., Ltd., HNP-9): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (8)

Paraffin wax (produced by Nippon Seiro Co., Ltd., FNP0080): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (9)

Paraffin wax (produced by Nippon Seiro Co., Ltd., FNP0085): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (10)

Polyethylene wax (produced by Toyo-Petrolite Co., Ltd., Polywax 400 (PW 400)); 50 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (11)

Fischer-Tropsch wax (produced by Nippon Seiro Co., Ltd., HNP-5): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.20 μm are dispersed.

Preparation of Release Agent Dispersion Liquid (12)

Polyethylene wax (produced by Toyo-Petrolite Co., Ltd., Polywax 850 (PW 850)): 50 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.23 μm are dispersed.

Preparation of Release Agent Dispersion Liquid (13)

Polyethylene wax (produced by Toyo-Petrolite Co., Ltd., Polywax 725 (PW 725)): 50 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (14)

Paraffin wax (produced by Nippon Seiro Co., Ltd., FT105): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (15)

Paraffin wax (produced by Nippon Seiro Co., Ltd., FNP0115): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.25 μm are dispersed.

Preparation of Release Agent Dispersion Liquid (16)

Polyethylene wax (produced by Toyo-Petrolite Co., Ltd., Polywax 1000 (PW 1000)): 50 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (17)

Paraffin wax (produced by Nippon Seiro Co., Ltd., FT100): 50 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.25 μm are dispersed.

Preparation of Release Agent Dispersion Liquid (18)

Paraffin wax (produced by Nippon Seiro Co., Ltd., FNP0115): 25 parts

Polyethylene wax (produced by Toyo-Petrolite Co., Ltd., Polywax 850 (PW 850)): 25 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.22 μm are dispersed.

Preparation of Release Agent Dispersion Liquid (19)

Polyethylene wax (produced by Toyo-Petrolite Co., Ltd., Polywax 1000 (PW 1000)): 25 parts Paraffin wax (produced by Nippon Seiro Co., Ltd., FT105): 25 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.23 μm are dispersed.

Preparation of Release Agent Dispersion Liquid (20)

Paraffin wax (produced by Nippon Seiro Co., Ltd., FNP0115): 25 parts

Paraffin wax (produced by Nippon Seiro Co., Ltd., FT105): 25 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.24 μm are dispersed.

Preparation of Release Agent Dispersion Liquid (21)

Paraffin wax (produced by Nippon Seiro Co., Ltd., FNP0090): 25 parts

Paraffin wax (produced by Nippon Seiro Co., Ltd., FNP0100): 25 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (22)

Paraffin wax (produced by Nippon Seiro Co., Ltd., FNP0090): 25 parts

Fischer-Tropsch wax (produced by Nippon Seiro Co., Ltd., HNP0190): 25 parts

Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.21 μm are dispersed.

Preparation of Release Agent Dispersion Liquid (23)

Paraffin wax (produced by Nippon Seiro Co., Ltd., FNP0090): 25 parts

Polyethylene wax (produced by Toyo-Petrolite Co., Ltd., Polywax 600 (PW 600)): 25 parts Anionic surfactant (produced by Dai-Ichi Kogyo Seiyaku Co., Ltd., NEOGEN RK): 1.0 part Ion-exchange water: 200 parts The above components are mixed and heated to 140° C., and the mixture is dispersed with a homogenizer (produced by IKA, Ultra-Turrax T50). Subsequently, a dispersion treatment is conducted with a Manton Gaulin high-pressure homogenizer (produced by Gaulin Corporation) for 360 minutes to prepare a release agent dispersion liquid (solid content concentration: 20%) in which release agent particles having a volume average particle diameter of 0.22 μm are dispersed.

Preparation of Glossy Pigment Particle Dispersion Liquid

Aluminum pigment (produced by Showa Aluminum Powder K.K., 2173EA): 100 parts

Anionic surfactant (produced by Dai-Ichi Kogyo Seiyaku Co., Ltd., NEOGEN R): 1.5 parts Ion-exchange water: 900 parts A solvent is removed from a paste of the aluminum pigment. The above components are then mixed and dispersed with an emulsification dispersing machine CAVITRON (produced by Pacific Machinery & Engineering Co., Ltd., CR 1010) for about one hour to prepare a coloring agent dispersion liquid (solid content concentration: 10%) in which the glossy pigment particles (aluminum pigment particles) are dispersed.

Preparation of Toner

Resin particle dispersion liquid (1): 450 parts

Release agent dispersion liquid (1): 50 parts

Glossy pigment particle dispersion liquid: 21.74 parts

Nonionic surfactant (IGEPAL CA 897): 1.40 parts

The above raw materials are put in a 2-L cylindrical stainless container and dispersed and mixed using a homogenizer (produced by IKA, Ultra-Turrax T50) at a number of revolutions of 4,000 rpm for 10 minutes while applying a shear stress. Next, 1.75 parts of a 10% aqueous nitric acid solution of polyaluminum chloride is slowly added dropwise as a flocculant to the resulting mixture, and dispersion and mixing are performed for 15 minutes at a number of revolutions of the homogenizer of 5,000 rpm. Thus, a raw-material dispersion liquid is prepared.

Subsequently, the raw-material dispersion liquid is transferred to a polymerization reactor equipped with a thermometer and a stirrer having a blade for forming a laminar flow, the blade including two paddles. Heating of the polymerization reactor is started in a mantle heater at a number of stirring revolutions of 810 rpm to accelerate the growth of aggregated particles at 54° C. In this step, the pH of the raw-material dispersion liquid is controlled in the range of 2.2 or more and 3.5 or less with 0.3 N nitric acid or a 1 N aqueous sodium hydroxide solution. The raw-material dispersion liquid is maintained at a pH in the above range for about two hours to form aggregated particles. In this case, the volume average particle diameter of the aggregated particles measured with a Multisizer II (aperture diameter: 50 μm, produced by Beckman Coulter Inc.) is 10.6 μm.

Next, 100 parts of the resin particle dispersion liquid (1) is further added thereto so that the resin particles of the binder resin adhere to the surfaces of the aggregated particles. The temperature is further increased to 56° C., and the aggregated particles are adjusted while the size and the morphology of the particles are observed with an optical microscope and the Multisizer II. Subsequently, in order to cause the aggregated particles to coalesce, the pH is increased to 8.0, and the temperature is then increased to 67° C. After the coalescence of the aggregated particles is confirmed with the optical microscope, the pH is decreased to 6.0 while maintaining the temperature of 67° C. After one hour, the heating is stopped, and the particles are cooled at a rate of temperature decrease of 1.0° C./min. The particles are then sieved through a 20-μm mesh, repeatedly washed with water, and then dried in a vacuum dryer, thus obtaining toner particles. The toner particles have a volume average particle diameter of 12.5 μm.

Next, 1.5 parts of hydrophobic silica (produced by Nippon Aerosil Co., Ltd., RY 50) is blended with 100 parts of the resulting toner particles using a sample mill at 10,000 rpm for 30 seconds. Subsequently, the resulting mixture is sieved through a vibrating screen having openings of 45 μm to prepare a toner. In this case, the volume average particle diameter of the aggregated particles measured with the Multisizer II (aperture diameter: 50 μm, produced by Beckman Coulter Inc.) is 10.4 μm.

Preparation of Carrier

Ferrite particles (volume average particle diameter: 35 μm): 100 parts

Toluene: 14 parts

Perfluoroacrylate copolymer (Critical surface tension: 24 dyn/cm): 1.6 parts

Carbon black (trade name: VXC-72, produced by Cabot Corporation, volume resistivity: 100 Ωcm or less): 0.12 parts Cross-linked melamine resin particles (average particle diameter: 0.3 μm, insoluble in toluene): 0.3 parts First, the carbon black is diluted with toluene, and the mixture is added to the perfluoroacrylate copolymer. The mixture is dispersed with a sand mill. Next, the above components except for the ferrite particles are dispersed with a stirrer for 10 minutes to prepare a liquid for forming a coating layer. The liquid for forming a coating layer and the ferrite particles are then put in a vacuum degassing kneader, and the resulting mixture is stirred at a temperature of 60° C. for 30 minutes. Subsequently, the toluene is distilled off under reduced pressure to form a resin coating layer. Thus, a carrier is prepared.

Preparation of Developer

To a 2-L V-blender, 36 parts of the toner and 414 parts of the carrier prepared above are put and stirred for 20 minutes. The resulting mixture is sieved through a 212-μm mesh to prepare a developer.

Examples 2 to 46 and Comparative Examples 1 and 2

Toners are prepared as in Example 1 except that the conditions are changed as follows in the method for producing the glossy toner described in Example 1.

In Example 2, the number of stirring revolutions in the step of accelerating the growth of the aggregated particles of Example 1 is changed from 810 rpm to 520 rpm, and the temperature in the step of causing the aggregated particles to coalesce is changed from 67° C. to 79.5° C.

In Example 3, the number of stirring revolutions in the step of accelerating the growth of the aggregated particles of Example 1 is changed from 810 rpm to 630 rpm, and the temperature in the step of causing the aggregated particles to coalesce is changed from 67° C. to 75.5° C.

In Example 4, the number of stirring revolutions in the step of accelerating the growth of the aggregated particles of Example 1 is changed from 810 rpm to 670 rpm, and the temperature in the step of causing the aggregated particles to coalesce is changed from 67° C. to 75° C.

In Example 5, the number of stirring revolutions in the step of accelerating the growth of the aggregated particles of Example 1 is changed from 810 rpm to 730 rpm, and the temperature in the step of causing the aggregated particles to coalesce is changed from 67° C. to 71° C.

In Example 6, the number of stirring revolutions in the step of accelerating the growth of the aggregated particles of Example 1 is changed from 810 rpm to 780 rpm, and the temperature in the step of causing the aggregated particles to coalesce is changed from 67° C. to 70° C.

In Example 7, the number of stirring revolutions in the step of accelerating the growth of the aggregated particles of Example 1 is changed from 810 rpm to 870 rpm, and the temperature in the step of causing the aggregated particles to coalesce is changed from 67° C. to 66° C.

In Example 8, the number of stirring revolutions in the step of accelerating the growth of the aggregated particles of Example 1 is changed from 810 rpm to 890 rpm, and the temperature in the step of causing the aggregated particles to coalesce is changed from 67° C. to 65° C.

In Example 9, the number of stirring revolutions in the step of accelerating the growth of the aggregated particles of Example 1 is changed from 810 rpm to 1,030 rpm, and the temperature in the step of causing the aggregated particles to coalesce is changed from 67° C. to 63.5° C.

In Example 10, the number of stirring revolutions in the step of accelerating the growth of the aggregated particles of Example 1 is changed from 810 rpm to 1,180 rpm, and the temperature in the step of causing the aggregated particles to coalesce is changed from 67° C. to 62.5° C.

In Example 11, the number of stirring revolutions in the step of accelerating the growth of the aggregated particles of Example 1 is changed from 810 rpm to 1,320 rpm, and the temperature in the step of causing the aggregated particles to coalesce is changed from 67° C. to 62° C.

In Example 12, the number of stirring revolutions in the step of accelerating the growth of the aggregated particles of Example 1 is changed from 810 rpm to 1,550 rpm, and the temperature in the step of causing the aggregated particles to coalesce is changed from 67° C. to 81.5° C.

In Example 13, the number of stirring revolutions in the step of accelerating the growth of the aggregated particles of Example 1 is changed from 810 rpm to 1,440 rpm, and the temperature in the step of causing the aggregated particles to coalesce is changed from 67° C. to 79° C.

In Example 14, the number of stirring revolutions in the step of accelerating the growth of the aggregated particles of Example 1 is changed from 810 rpm to 1,150 rpm, and the temperature in the step of causing the aggregated particles to coalesce is changed from 67° C. to 77.5° C.

In Example 15, the number of stirring revolutions in the step of accelerating the growth of the aggregated particles of Example 1 is changed from 810 rpm to 980 rpm, and the temperature in the step of causing the aggregated particles to coalesce is changed from 67° C. to 73.5° C.

In Example 16, the number of stirring revolutions in the step of accelerating the growth of the aggregated particles of Example 1 is changed from 810 rpm to 870 rpm, and the temperature in the step of causing the aggregated particles to coalesce is changed from 67° C. to 70° C.

In Example 17, the number of stirring revolutions in the step of accelerating the growth of the aggregated particles of Example 1 is changed from 810 rpm to 840 rpm, and the temperature in the step of causing the aggregated particles to coalesce is changed from 67° C. to 69.5° C.

In Example 18, the number of stirring revolutions in the step of accelerating the growth of the aggregated particles of Example 1 is changed from 810 rpm to 770 rpm, and the temperature in the step of causing the aggregated particles to coalesce is changed from 67° C. to 66° C.

In Example 19, the number of stirring revolutions in the step of accelerating the growth of the aggregated particles of Example 1 is changed from 810 rpm to 700 rpm, and the temperature in the step of causing the aggregated particles to coalesce is changed from 67° C. to 65° C.

In Example 20, the number of stirring revolutions in the step of accelerating the growth of the aggregated particles of Example 1 is changed from 810 rpm to 650 rpm, and the temperature in the step of causing the aggregated particles to coalesce is changed from 67° C. to 63.5° C.

In Example 21, the number of stirring revolutions in the step of accelerating the growth of the aggregated particles of Example 1 is changed from 810 rpm to 630 rpm, and the temperature in the step of causing the aggregated particles to coalesce is changed from 67° C. to 62.5° C.

In Example 22, the number of stirring revolutions in the step of accelerating the growth of the aggregated particles of Example 1 is changed from 810 rpm to 500 rpm, and the temperature in the step of causing the aggregated particles to coalesce is changed from 67° C. to 61.5° C.

In Example 23, the release agent dispersion liquid (1) used in Example 1 is changed to the release agent dispersion liquid (2), the number of stirring revolutions in the step of accelerating the growth of the aggregated particles is changed from 810 rpm to 800 rpm, and the temperature in the step of causing the aggregated particles to coalesce is changed from 67° C. to 67.5° C.

In Example 24, the release agent dispersion liquid (1) used in Example 1 is changed to the release agent dispersion liquid (3), the number of stirring revolutions in the step of accelerating the growth of the aggregated particles is changed from 810 rpm to 770 rpm, and the temperature in the step of causing the aggregated particles to coalesce is changed from 67° C. to 66.5° C.

In Example 25, the release agent dispersion liquid (1) used in Example 1 is changed to the release agent dispersion liquid (4), the number of stirring revolutions in the step of accelerating the growth of the aggregated particles is changed from 810 rpm to 800 rpm.

In Example 26, the release agent dispersion liquid (1) used in Example 1 is changed to the release agent dispersion liquid (5), the number of stirring revolutions in the step of accelerating the growth of the aggregated particles is changed from 810 rpm to 770 rpm, and the temperature in the step of causing the aggregated particles to coalesce is changed from 67° C. to 75° C.

In Example 27, the release agent dispersion liquid (1) used in Example 1 is changed to the release agent dispersion liquid (6), the number of stirring revolutions in the step of accelerating the growth of the aggregated particles is changed from 810 rpm to 760 rpm, and the temperature in the step of causing the aggregated particles to coalesce is changed from 67° C. to 74° C.

In Example 28, the release agent dispersion liquid (1) used in Example 1 is changed to the release agent dispersion liquid (7), the number of stirring revolutions in the step of accelerating the growth of the aggregated particles is changed from 810 rpm to 870 rpm, and the temperature in the step of causing the aggregated particles to coalesce is changed from 67° C. to 73.5° C.

In Example 29, the release agent dispersion liquid (1) used in Example 1 is changed to the release agent dispersion liquid (8), the number of stirring revolutions in the step of accelerating the growth of the aggregated particles is changed from 810 rpm to 800 rpm, and the temperature in the step of causing the aggregated particles to coalesce is changed from 67° C. to 69° C.

In Example 30, the release agent dispersion liquid (1) used in Example 1 is changed to the release agent dispersion liquid (9), the number of stirring revolutions in the step of accelerating the growth of the aggregated particles is changed from 810 rpm to 800 rpm, and the temperature in the step of causing the aggregated particles to coalesce is changed from 67° C. to 69.5° C.

In Example 31, the release agent dispersion liquid (1) used in Example 1 is changed to the release agent dispersion liquid (10), the number of stirring revolutions in the step of accelerating the growth of the aggregated particles is changed from 810 rpm to 810 rpm, and the temperature in the step of causing the aggregated particles to coalesce is changed from 67° C. to 72° C.

In Example 32, the release agent dispersion liquid (1) used in Example 1 is changed to the release agent dispersion liquid (11), the number of stirring revolutions in the step of accelerating the growth of the aggregated particles is changed from 810 rpm to 790 rpm, and the temperature in the step of causing the aggregated particles to coalesce is changed from 67° C. to 76° C.

In Example 33, the release agent dispersion liquid (1) used in Example 1 is changed to the release agent dispersion liquid (12), the number of stirring revolutions in the step of accelerating the growth of the aggregated particles is changed from 810 rpm to 800 rpm, and the temperature in the step of causing the aggregated particles to coalesce is changed from 67° C. to 70° C.

In Example 34, the release agent dispersion liquid (1) used in Example 1 is changed to the release agent dispersion liquid (13), and the temperature in the step of causing the aggregated particles to coalesce is changed from 67° C. to 67.5° C.

In Example 35, the release agent dispersion liquid (1) used in Example 1 is changed to the release agent dispersion liquid (14), the number of stirring revolutions in the step of accelerating the growth of the aggregated particles is changed from 810 rpm to 800 rpm, and the temperature in the step of causing the aggregated particles to coalesce is changed from 67° C. to 68.5° C.

In Example 36, the release agent dispersion liquid (1) used in Example 1 is changed to the release agent dispersion liquid (15), the number of stirring revolutions in the step of accelerating the growth of the aggregated particles is changed from 810 rpm to 800 rpm, and the temperature in the step of causing the aggregated particles to coalesce is changed from 67° C. to 70.5° C.

In Example 37, the release agent dispersion liquid (1) used in Example 1 is changed to the release agent dispersion liquid (16), the number of stirring revolutions in the step of accelerating the growth of the aggregated particles is changed from 810 rpm to 780 rpm, and the temperature in the step of causing the aggregated particles to coalesce is changed from 67° C. to 72.5° C.

In Example 38, the release agent dispersion liquid (1) used in Example 1 is changed to the release agent dispersion liquid (17), the number of stirring revolutions in the step of accelerating the growth of the aggregated particles is changed from 810 rpm to 790 rpm, and the temperature in the step of causing the aggregated particles to coalesce is changed from 67° C. to 73° C.

In Example 39, the release agent dispersion liquid (1) used in Example 1 is changed to the release agent dispersion liquid (18), the number of stirring revolutions in the step of accelerating the growth of the aggregated particles is changed from 810 rpm to 820 rpm, and the temperature in the step of causing the aggregated particles to coalesce is changed from 67° C. to 75.5° C.

In Example 40, the release agent dispersion liquid (1) used in Example 1 is changed to the release agent dispersion liquid (19), the number of stirring revolutions in the step of accelerating the growth of the aggregated particles is changed from 810 rpm to 780 rpm, and the temperature in the step of causing the aggregated particles to coalesce is changed from 67° C. to 76° C.

In Example 41, the release agent dispersion liquid (1) used in Example 1 is changed to the release agent dispersion liquid (20), the number of stirring revolutions in the step of accelerating the growth of the aggregated particles is changed from 810 rpm to 760 rpm, and the temperature in the step of causing the aggregated particles to coalesce is changed from 67° C. to 77° C.

In Example 42, the release agent dispersion liquid (1) used in Example 1 is changed to the release agent dispersion liquid (21), the number of stirring revolutions in the step of accelerating the growth of the aggregated particles is changed from 810 rpm to 790 rpm, and the temperature in the step of causing the aggregated particles to coalesce is changed from 67° C. to 65.5° C.

In Example 43, the release agent dispersion liquid (1) used in Example 1 is changed to the release agent dispersion liquid (22), the number of stirring revolutions in the step of accelerating the growth of the aggregated particles is changed from 810 rpm to 800 rpm, and the temperature in the step of causing the aggregated particles to coalesce is changed from 67° C. to 64.5° C.

In Example 44, the release agent dispersion liquid (1) used in Example 1 is changed to the release agent dispersion liquid (23), the number of stirring revolutions in the step of accelerating the growth of the aggregated particles is changed from 810 rpm to 800 rpm, and the temperature in the step of causing the aggregated particles to coalesce is changed from 67° C. to 67.5° C.

In Example 45, the resin particle dispersion liquid (1) used in Example 1 is changed to the resin particle dispersion liquid (2), the number of stirring revolutions in the step of accelerating the growth of the aggregated particles is changed from 810 rpm to 780 rpm, and the temperature in the step of causing the aggregated particles to coalesce is changed from 67° C. to 68° C.

In Example 46, a toner is prepared by a molten-kneading and pulverizing method.

Resin particle dispersion liquid (1): 450 parts

Release agent dispersion liquid (1): 50 parts

Glossy pigment particle dispersion liquid: 2.2 parts

The above dispersion liquids are weighed, and then mixed with a ball mill. The mixture is dried. The resulting mixture is heated and melted with a screw extruder (extruder) and further kneaded. After the kneading is completed, the resulting kneaded mixture is cooled and solidified. The solidified kneaded mixture is first coarsely crushed with a coarse crusher such as a hammer mill, and then finely pulverized with a fine pulverizer such as a jet mill. After the completion of the fine pulverization, the finely pulverized particles are classified with an Elbow-Jet classifier or the like to remove fine particles and coarse particles.

The average maximum thickness of the toner after the classification is substantially the same as the average equivalent-circle diameter thereof. Therefore, in order to adjust the average maximum thickness and the average equivalent-circle diameter to be desired values, a dispersion liquid containing the toner particles after the classification and zirconia beads having a particle diameter of 2 mm is prepared, and stirred with a bead mill dispersion device. The toner particles are deformed by the contact with the beads, whereby the desired average maximum thickness and the average equivalent-circle diameter are obtained (Note that the above dispersion liquid may contain water, a surfactant, or the like). The treatment is performed for 50 minutes while a rotating disc of the bead mill is rotated at 5,000 rpm. The toner is isolated from the resulting dispersion liquid, repeatedly washed with water, and then dried in a vacuum dryer, thus obtaining toner particles. Next, 1.5 parts of hydrophobic silica (produced by Nippon Aerosil Co., Ltd., RY 50) and 1.0 part of hydrophobic titanium oxide (produced by Nippon Aerosil Co., Ltd., T805) are blended with 100 parts of the resulting toner particles using a sample mill at 10,000 rpm for 30 seconds. Subsequently, the resulting mixture is sieved through a vibrating screen having openings of 45 μm to prepare a toner.

A developer is prepared as in Example 1 using the resulting toner particles.

In Comparative Example 1, the two paddles used in the step of accelerating the growth of the aggregated particles in Example 1 are changed to four paddles, the number of stirring revolutions is changed from 810 rpm to 500 rpm, and the temperature in the step of causing the aggregated particles to coalesce is changed from 67° C. to 90° C.

In Comparative Example 2, a toner is prepared as in Example 46 except that the step of adjusting the average maximum thickness and the average equivalent-circle diameter with a bead mill in Example 46 is not performed. A developer is prepared using the resulting toner.

Measurement

"The ratio (A/B)", "the ratio (C/D) of the average maximum thickness C to the average equivalent-circle diameter D of a toner", and "among the total number of pigment particles observed on a cross section of a toner in the thickness direction thereof, the number of pigment particles having long-axis directions that form an angle of −30° to +30° with respect to a long-axis direction of the cross section of the toner (hereinafter simply referred to as "the number of pigment particles in the range of ±30°") are measured by the methods described above. The results are shown in Tables 1 and 2 below.

Evaluation Test

Glossiness

Solid images are formed by the following method.

A developing device of a DocuCentre-III C7600 (modified device) produced by Fuji Xerox Co., Ltd. is filled with a developer used as a sample, and a solid image with an amount of toner applied of 4.5 g/cm$^2$ is formed on recording paper (OK Top Coat+paper, produced by Oji Paper Co., Ltd.) at a process speed of 350 mm/sec, at a fixing temperature of 210° C., and a fixing pressure of 4.0 kgf/cm$^2$.

The glossiness of the resulting solid image is evaluated by visual observation using the following criterion. Specifically, the glossiness is evaluated by visual observation under illumination for color observation (natural daylight illumination) in accordance with "Testing methods for paints, Part 4: Visual characteristics of film, Section 3: Visual comparison of the color of paints" specified in JIS K5600-4-3: 1999. A perceived glossiness of particles (a shiny effect of the glossiness) and an optical effect (a change in the hue depending on the angle of view) are evaluated by the criterion described below. In the criterion, 2 or more is a level of practical use.

5: The perceived glossiness of particles and the optical effect are harmonized.

4: The particles are perceived to be somewhat glossy and the optical effect is somewhat observed.

3: The image has a normal appearance.

2: The image has a somewhat blurred appearance.

1: No glossiness of particles or optical effect is observed.

TABLE 1

| | Release agent | | | | | | | | | Toner | | | |
|---|---|---|---|---|---|---|---|---|---|---|---|---|---|
| | Dispersion liquid | Release agent 1 Type | Release agent 1 Molecular weight | Release agent 2 Type | Release agent 2 Molecular weight | Melt viscosity (Pa · s) | Melting temperature (° C.) | Full width at half maximum of melting (° C.) | Resin Type | Ratio (A/B) | The number of pigment particles in the range of ±30° (%) | Ratio (C/D) | Evaluation Glossiness |
| Example 1 | (1) | PW600 | 600 | | | 3.5 | 91.7 | 12 | Polyester | 63 | 86 | 0.075 | 5 |
| Example 2 | (1) | PW600 | 600 | | | 3.5 | 91.7 | 12 | Polyester | 3 | 61 | 0.455 | 2 |
| Example 3 | (1) | PW600 | 600 | | | 3.5 | 91.7 | 12 | Polyester | 18 | 69 | 0.220 | 2 |
| Example 4 | (1) | PW600 | 600 | | | 3.5 | 91.7 | 12 | Polyester | 23 | 70 | 0.180 | 3 |
| Example 5 | (1) | PW600 | 600 | | | 3.5 | 91.7 | 12 | Polyester | 37 | 78 | 0.120 | 3 |
| Example 6 | (1) | PW600 | 600 | | | 3.5 | 91.7 | 12 | Polyester | 44 | 80 | 0.090 | 4 |
| Example 7 | (1) | PW600 | 600 | | | 3.5 | 91.7 | 12 | Polyester | 78 | 88 | 0.050 | 4 |
| Example 8 | (1) | PW600 | 600 | | | 3.5 | 91.7 | 12 | Polyester | 80 | 90 | 0.045 | 3 |
| Example 9 | (1) | PW600 | 600 | | | 3.5 | 91.7 | 12 | Polyester | 85 | 93 | 0.019 | 3 |
| Example 10 | (1) | PW600 | 600 | | | 3.5 | 91.7 | 12 | Polyester | 92 | 95 | 0.007 | 2 |
| Example 11 | (1) | PW600 | 600 | | | 3.5 | 91.7 | 12 | Polyester | 97 | 96 | 0.003 | 2 |
| Example 12 | (1) | PW600 | 600 | | | 3.5 | 91.7 | 12 | Polyester | 63 | 57 | 0.001 | 5 |
| Example 13 | (1) | PW600 | 600 | | | 3.5 | 91.7 | 12 | Polyester | 63 | 62 | 0.002 | 4 |
| Example 14 | (1) | PW600 | 600 | | | 3.5 | 91.7 | 12 | Polyester | 63 | 65 | 0.009 | 4 |
| Example 15 | (1) | PW600 | 600 | | | 3.5 | 91.7 | 12 | Polyester | 63 | 73 | 0.025 | 4 |
| Example 16 | (1) | PW600 | 600 | | | 3.5 | 91.7 | 12 | Polyester | 63 | 80 | 0.050 | 4 |
| Example 17 | (1) | PW600 | 600 | | | 3.5 | 91.7 | 12 | Polyester | 63 | 81 | 0.060 | 5 |
| Example 18 | (1) | PW600 | 600 | | | 3.5 | 91.7 | 12 | Polyester | 63 | 88 | 0.090 | 5 |
| Example 19 | (1) | PW600 | 600 | | | 3.5 | 91.7 | 12 | Polyester | 63 | 90 | 0.150 | 4 |
| Example 20 | (1) | PW600 | 600 | | | 3.5 | 91.7 | 12 | Polyester | 63 | 93 | 0.200 | 4 |
| Example 21 | (1) | PW600 | 600 | | | 3.5 | 91.7 | 12 | Polyester | 63 | 95 | 0.230 | 4 |
| Example 22 | (1) | PW600 | 600 | | | 3.5 | 91.7 | 12 | Polyester | 63 | 97 | 0.480 | 4 |
| Example 23 | (2) | FNP0090 | 576 | | | 4.8 | 90 | 12 | Polyester | 66 | 85 | 0.076 | 5 |
| Example 24 | (3) | HNP-0190 | 570 | | | 4.3 | 89 | 10 | Polyester | 64 | 87 | 0.090 | 5 |

TABLE 2

| | Release agent | | | | | | | | | Toner | | | |
|---|---|---|---|---|---|---|---|---|---|---|---|---|---|
| | Dispersion liquid | Release agent 1 Type | Release agent 1 Molecular weight | Release agent 2 Type | Release agent 2 Molecular weight | Melt viscosity (Pa · s) | Melting temperature (° C.) | Full width at half maximum of melting (° C.) | Resin Type | Ratio (A/B) | The number of pigment particles in the range of ±30° (%) | Ratio (C/D) | Evaluation Glossiness |
| Example 25 | (4) | HNP-12 | 320 | | | 0.9 | 67 | 4 | Polyester | 94 | 86 | 0.080 | 2 |
| Example 26 | (5) | HNP-11 | 330 | | | 1.5 | 68 | 3 | Polyester | 89 | 70 | 0.090 | 3 |
| Example 27 | (6) | HNP-10 | 410 | | | 2.1 | 76 | 7 | Polyester | 85 | 72 | 0.100 | 3 |
| Example 28 | (7) | HNP-9 | 400 | | | 2 | 75 | 6 | Polyester | 83 | 73 | 0.050 | 3 |
| Example 29 | (8) | FNP0080 | 531 | | | 1.3 | 77 | 7 | Polyester | 79 | 82 | 0.080 | 4 |
| Example 30 | (9) | FNP0085 | 564 | | | 1.5 | 85 | 9 | Polyester | 77 | 81 | 0.080 | 4 |
| Example 31 | (10) | PW400 | 400 | | | 2.3 | 79.5 | 8 | Polyester | 84 | 76 | 0.075 | 3 |
| Example 32 | (11) | HNP-5 | 280 | | | 2.4 | 62 | 6 | Polyester | 83 | 68 | 0.090 | 3 |
| Example 33 | (12) | PW850 | 850 | | | 9 | 107 | 18 | Polyester | 45 | 80 | 0.080 | 4 |
| Example 34 | (13) | PW725 | 725 | | | 6 | 104 | 18 | Polyester | 51 | 85 | 0.075 | 4 |
| Example 35 | (14) | FT105 | 870 | | | 9.1 | 104.5 | 18 | Polyester | 48 | 83 | 0.080 | 4 |
| Example 36 | (15) | FNP0115 | 1,100 | | | 12 | 113.5 | 17 | Polyester | 33 | 79 | 0.080 | 3 |
| Example 37 | (16) | PW1000 | 1,000 | | | 15 | 113 | 24 | Polyester | 35 | 75 | 0.090 | 3 |
| Example 38 | (17) | FT100 | 708 | | | 5.5 | 98 | 21 | Polyester | 37 | 74 | 0.085 | 3 |
| Example 39 | (18) | FNP0115 | 980 | PW850 | 850 | 10.5 | 111 | 19 | Polyester | 34 | 69 | 0.070 | 3 |
| Example 40 | (19) | PW1000 | 950 | FT105 | 870 | 13 | 109 | 20 | Polyester | 32 | 68 | 0.090 | 3 |
| Example 41 | (20) | FNP0115 | 1,050 | FT105 | 870 | 11 | 110 | 20 | Polyester | 29 | 66 | 0.100 | 3 |
| Example 42 | (21) | FNP0090 | 590 | FNP0100 | 602 | 4.9 | 93 | 12 | Polyester | 65 | 89 | 0.085 | 5 |
| Example 43 | (22) | FNP0090 | 570 | HNP0190 | 570 | 4.5 | 91 | 11 | Polyester | 67 | 91 | 0.077 | 5 |
| Example 44 | (23) | FNP0090 | 580 | PW600 | 600 | 4.2 | 94 | 12 | Polyester | 65 | 85 | 0.080 | 5 |
| Example 45 | (1) | PW600 | 600 | | | 3.5 | 91.7 | 12 | Styrene-acryl | 55 | 84 | 0.090 | 4 |
| Example 46 | (1) | PW600 | 600 | | | 3.5 | 91.7 | 12 | Polyester | 3 | 60 | 0.481 | 2 |
| Comparative Example 1 | (1) | PW600 | 600 | | | 3.5 | 91.7 | 12 | Polyester | 1.8 | 10 | 1.050 | 1 |
| Comparative Example 2 | (1) | PW600 | 600 | | | 3.5 | 91.7 | 12 | Polyester | 1 | 8 | 1.020 | 1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner comprising:

a binder resin;

pigment particles; and a polyalkylene, wherein the following formula is satisfied:

$$2 \leq A/B \leq 100$$

where A represents a reflectance at a light-receiving angle of +30° and B represents a reflectance at a light-receiving angle of −30°, A and B being measured when a solid fixed image formed by the toner is irradiated with incident light at an incident angle of −45° using a goniophotometer, the polyalkylene has a melting temperature of from 75° C. to 110° C., the polyalkylene has a full width at half maximum of melting of from 5° C. to 20° C., and the toner has an average equivalent-circle diameter D, which is larger than an average maximum thickness C of the toner, and the following formula is satisfied:

$$E \geq 60$$

where E represents a ratio (%) of a number of pigment particles having long-axis directions that form an angle of −30° to +30° with respect to a long-axis direction of a cross section of the toner in a thickness direction thereof to a total number of pigment particles observed in the cross section.

2. The toner according to claim 1, wherein the polyalkylene has a melt viscosity of from 1.0 Pa·s to 12.0 Pa·s.

3. The toner according to claim 1, wherein the polyalkylene has a melt viscosity of from 2.0 Pa·s to 10.0 Pa·s.

4. The toner according to claim 1, wherein a ratio (C/D) of the average maximum thickness C of the toner to the average equivalent-circle diameter D of the toner is in a range of from 0.001 to 0.500.

5. The toner according to claim 1, further comprising pigment particles flaky in shape.

6. A developer comprising:

the toner according to claim 1; and a carrier.

7. The developer according to claim 6, wherein the toner has a ratio (C/D) of the average maximum thickness C of the toner to the average equivalent-circle diameter D of the toner in a range of from 0.001 to 0.500.

8. A toner cartridge comprising a container that contains the toner according to claim 1.

9. The toner cartridge according to claim 8, wherein the toner has a ratio (C/D) of the average maximum thickness C to the average equivalent-circle diameter D in a range of from 0.001 to 0.500.

* * * * *